United States Patent [19]

Finn

[11] 4,173,242

[45] Nov. 6, 1979

[54] BILLFOLD BILL FILE WITH MINIMUM PANEL AREA

[76] Inventor: Donald J. Finn, Sea-Ranch-Club - Apt 712, 5100 North Ocean Blvd., Ft. Lauderdale, Fla. 33308

[21] Appl. No.: 969,719

[22] Filed: Dec. 15, 1978

[51] Int. Cl.[2] ..... A45C 1/06

[52] U.S. Cl. ..... 150/38

[58] Field of Search ..... 150/38, 39, 35, 34, 150/30, 28 R

[56] References Cited

U.S. PATENT DOCUMENTS

| | | | |
|---|---|---|---|
| 1,564,967 | 12/1925 | Kulick | 150/28 R |
| 1,749,020 | 3/1930 | Curry | 150/38 |

*Primary Examiner*—Donald F. Norton

*Attorney, Agent, or Firm*—Hiram A. Sturges

[57] ABSTRACT

A billfold file and billfold assembly comprising, a billfold, the billfold when completely unfolded having forward and rearward walls which are longer from left to right than from top to bottom, a panel assembly inside the billfold and having panels receiving bills therebetween, the panels each being of a length less than half the length of the billfold and of a length less than five inches so as to be substantially less than the length of a common U.S. currency bill, and means attaching the panels together in a manner permitting bills to be inserted therebetween.

6 Claims, 3 Drawing Figures

BILLFOLD BILL FILE WITH MINIMUM PANEL AREA

BACKGROUND OF THE INVENTION

This invention is in the field of billfold bill files and having multiple panels, each one with an index tab designating a different currency bill figure.

The field is illustrated by my patent U.S. Pat. No. 4,049,035 which issued Sept. 20, 1977, titled, CURRENCY BILL BILLFOLD FILE, inventor: Donald J. Finn.

In this patent application, the object was to make the panels so thin that they would not interfere with the folding of the billfold in such a manner as to make the billfold bunch up. The process of solving this problem involves a very expensive solution with very thin panels of very light thermoplasti material, such as flexible polypropylene of approximately 0.010 inch thickness.

A problem experienced is that material of such a small thickness tends to wrinkle so that the billfold file becomes unsightly and eventually not sufficiently functional.

Another patent application in my name titled, BILLFOLD BILL FILE, Ser. No. 746,196, was filed Nov. 30, 1976, and is now U.S. Pat. No. 4,134,437. In this case, the panels are of a semi-soft polypropylene of a thickness of approximately 0.010 or 0.015 inch thickness, in general, with certain areas adjacent folds where the billfold itself would fold being of approximately 0.005 thickness for ease of folding. However, it was my experience that although folding might be easier and economy was simpler, yet the thin panels tend to wrinkle and crumple.

I also applied for a patent, Ser. No. 795,647, filed May 10, 1977, titled: BILLFOLD FILE, on a construction which the intention was to have panels of very thin thermoplastic material of a thickness of approximately six and one-half mills to provide some thickness for the support of the tabs, but in general, a great thinness for ease of folding. Again the problem was crumpling and wrinkling of the material of the panels.

In these various applications, considerable attention was given to the way the panels are secured together and how the panels are secured to the billfold for minimizing the wrinkling of the panels resultant from the folding of the billfold. But, one problem was common to all of these billfold files, and that was that the panels cold vertically wrinkle by crumpling down toward the bottom of the billfold, simply because of the thinness of the panels. There was a dilemma. There was no way out. If the panels were made thicker, then the billfold got too bulky. If they were thin, they would crumple down toward the bottom of the billfold after substantial periods of use.

It is the object of this invention to eliminate one feature that was common to all of these previous inventions of mine, namely, to eliminate the having of the billfold panels extending substantially from one end of the billfold to the other. This made use of my later discovery that it was not necessary to have the panels going the length of the billfold. It was, instead, possible to have the panels be in only one section of the billfold and disposed between, either the two fold areas of a double-fold billfold, or between an end and the fold area of a single-fold billfold. This discovery reduced the volume of the material in a billfold by one-half, in terms of area, leaving more possibility for the panels to be thick so that they could be more stiff and resistant to crumpling down so that they would not crumple down toward the bottom of the billfold as the file was used.

Another advantage of my minimum panel area billfold file is the savings in material cost.

SUMMARY OF THE INVENTION

The major goal of this invention is to provide a billfold file and billfold assembly comprising, a billfold, the billfold when completely unfolded having forward and rearward walls which are longer from left to right than from top to bottom, a panel assembly inside the billfold and having panels for receiving bills therebetween and having currency indicia thereon, the panels each being of a length less than half the length of the billfold and of a length less than five inches so as to be substantially less than the length of a common U.S. currency bill, and means attaching the panels together in a manner permitting bills to be inserted therebetween. A part of this goal applies to the situation in which the billfold is of a woman's "clutch purse" type.

DESCRIPTION OF THE PREFERRED EMBODIMENT

Figure 1:
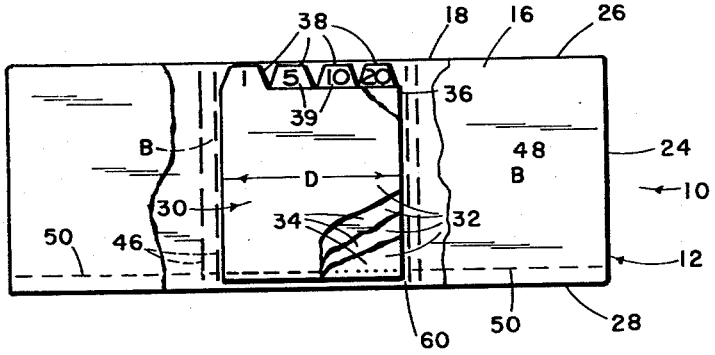
FIG. 1 is a frontal elevation of an open billfold of the double fold type as it would be seen looking at that outer side wall of the billfold which would be inside when the billfold is folded, the said side wall being broken away at the center for showing a billfold file therein, vertical dotted lines indicating bending areas in which the walls of the billfold are bent when closed, lower corners of each panel being broken away for showing panels therebehind.

Referring to FIG. 1 a billfold file and billfold assembly 10 of the double fold type is shown and has a billfold 12 which is in an open position and having its forward and rearward walls 16 and 18 in parallel vertical position, these being the outside walls which are straight when the billfold is open. The billfold in FIG. 1, in the open position, can be seen to be longer from its left side 22 to its right side 24 than it is from its top side 26 to its bottom side 28.

A panel assembly 30 is disposed between the forward and rearward walls 16 and 18 are comprises a plurality of vertical panels 32 of flexible material, the panels 32 being disposed in substantial parallelism, one in front of another, and parallel to the billfold walls 16 and 18.

Each two adjacent ones of the panels 32 have a vertical bill-receiving area 34 therebetween, the bill-receiving areas 34 each being open at their upper sides 36, and the space between the forward and rearward walls 16 and 18 is likewise open at its upper side in a conventional manner. The panels 32 are each of a dimension from left to right along the length of the billfold walls 16 and 18 which is less than half of the dimension of the billfold from left to right.

Also the panels 32 are each of a dimension D from left to right which is less than five inches so as to be substantially less than the length of a common U.S. currency bill, a suitable panel attaching means which can be stitching at 50 attaches the panels together at only such portions of each of the panels which are disposed exteriorly of the bill-receiving areas 34, the preferred place for the stitching 50 being to extend along the lower edge of the billfold and extending through the lower edges of the panels 32. The stitching 50 can be a part of the same stitching that would be conventional in a billfold of this type if it were not being used to carry a billfold file.

Each of the panels 32 has an upwardly extending tab 38 and each tab has a number thereon, shown at 39, defining a different denomination of currency bill.

Areas bordered by dotted lines 46 and 48 are the usual bend areas of the billfold and are disposed on each side of the panel assembly 30 so that the panel assembly does not interfere with the folding of the billfold, no matter how stiff or how flexible the panels 32 are made. This makes it possible for the panels 32 to be of sufficient stiffness that they tend not to sag during use and so that they do not wrinkle and that the tabs 38, which latter are of the same thickness and material as the remainder of each panel 32, are themselves strong tabs capable of holding their shape.

Figure 2:
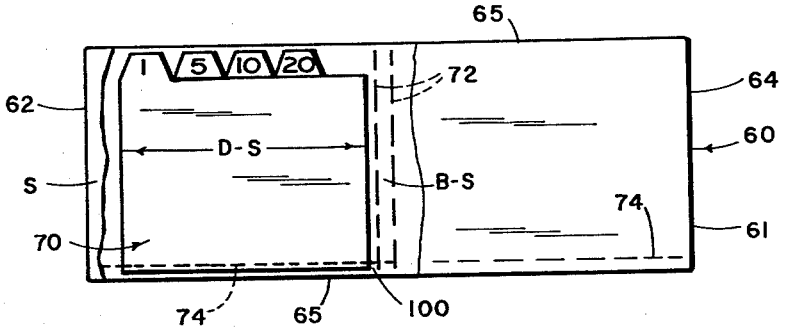
FIG. 2 is a view of a modified billfold file and billfold assembly in which the billfold itself is of the single fold type with dotted lines vertically disposed at the center outlining an area in which the walls of the billfold are bent when it is folded. The closer outer wall of the billfold is broken away for showing the billfold file therein.

Referring now to FIG. 2 a modification of the invention is there shown, in which a billfold file and billfold assembly 60, which has all of the same characteristics described for the billfold 10 in FIG. 1, with the exception that the billfold 60 is of the one-fold type, in which the bend area B-S between two dotted lines 72 is in the center between the left and right ends 62 and 64 of the billfold 61.

The billfold assembly 60 has a panel assembl 70 which is disposed on one side of the bend area B-S and there is a space S between the left end of the billfold 61 and the panel assembly 70, which can be, for example, ⅛ th inch or less, or even somewhat more. The other side of the panel assembly 70 is spaced by a distance indicated by the numeral 100 from the center of the bending area B-S by a very slight amount, it being preferred that the panel assembly 70 come up to the bending area B-S or be spaced from it, although it could extend as far as the center of the bending area B-S and still the panel assembly 70 would be a great improvement in enhancing the folding of a billfold over a construction in which a panel assembly extends across a bending area of the billfold. The panel assembly 70 is not further described because it is the same as the description used above for the panel assembly 30, although, as it can be seen, it can be of greater dimension from left to right. The panel assembly 70 is attached by suitable attaching means such as stitching 74 extending along the lower side of the billfold and extending through the panels of the panel assembly 70, the stitching 74 being preferably the same stitching used to sew the panels of the billfold together. The panels of the panel assembly 70 area of a dimension from left to right which is less than half of the dimension of the billfold 61 from left to right. The panels of the panel assembly 70 are each of a dimension from left to right which is less than five inches so as to be substantially less than the length of a common U.S. currency bill.

Figure 3:
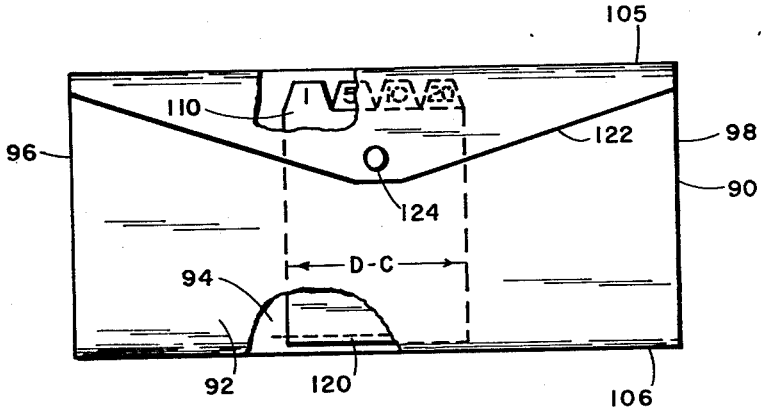
FIG. 3 is a frontal elevation of a billfold file and billfold assembly in which the billfold is of a type carried in a woman's purse, sometimes called a "clutch purse" and which latter is normally not folded between its ends but does have a folding flap at the top shown in closed position, a portion of the flap being broken away for showing the billfold file of this invention therebehind, other parts of the billfold file being shown in dotted lines, except for a lower left portion seen through a broken away part of the adjacent outer wall of a woman's flap purse.

Referring to FIG. 3 a billfold and billfold assembly is there shown at 90 and is of a type having a forward panel 92 and a rearward panel 94, receiving therebetween a billfold file panel assembly 110, descriptively similar to panel assemblies 30 and 70. Since the billfold file and billfold assembly 90 is not intended to be bent or folded and is of a type used in a woman's purse and commonly called a "clutch" purse, there is no concern with bend areas. It has a flap 122 which closes its upper side at times when the flap is down and fastened by a snap assembly 124, and the dimension of the billfold assembly 110 from left to right is indicated at D-C and it is preferably of a length between approximately substantially the entire length of the billfold with the exception of perhaps a one-fourth inch spacing from each end, as is not shown, all the way down to being perhaps even a third of the length of the billfold, as shown in FIG. 3. The dimension D-C of the panel assembly 110 in FIG. 3 is not critically important because there is no bending of the billfold involved. The panel assembly 110 is held in place by suitable attaching means such as stitching extending horizontally at 120 attaching the panel assembly to forward and rearward sides 92 and 94 of the billfold, or at least to one of them.

Since a common U.S. currency bill is about 6⅛ inches long, it is significant that the panels are of a length from left to right which is less than 5 inches so as to be substantially less than the length of the common U.S. currency bill, whereby there is a material savings and whereby the billfold is not made as bulky by the presence of the billfold file as it would otherwise be. It is, however, preferred that a substantial material savings and a substantial savings in bulk be accomplished by making the panels less than half of the length of a billfold in any case, and preferably less than approximately one-third of the length of the billfold in the case of a double-fold billfold.

I claim:

1. A billfold file and billfold assembly comprising a billfold said billfold when in one position having forward and rearward outside parallel vertical walls which are each straight, said billfold when in said one position being longer from left to right than from top to bottom, a panel assembly for receiving currency bills, said panel assembly being inside said billfold for quick, easy and accurate storage and removal of bills, said panel assembly comprising: a plurality of vertical panels of flexible material, said panels being disposed in substantial parallelism, each two adjacent ones of said panels having a vertical bill-receiving area therebetween, said bill-receiving areas each being at least at times open at their upper sides, said panels each being of a dimension from left to right which is less than half of the dimension of said billfold from left to right, said panels each being of a dimension from left to right which is less than five inches so as to be substantially less than the length of a common U.S. currency bill, panel attaching means attaching said panels together at only such portions of each of said panels as are disposed exteriorly of said bill-receiving areas, said panels each having currency indicia at their upper portions.

2. The billfold file and billfold assembly of claim 1 having said billfold being of the double-fold type in which the bend areas of the billfold separate the billfold into three areas, the dimension of said panel assembly from left to right being approximately the dimension from left to right of one of said billfold areas.

3. The billfold file and billfold assembly of claim 2 said panels each having a tab extending upwardly therefrom of substantially less than the dimension from left to right of the respective panel, said currency indicia being on said tabs.

4. The billfold file and billfold assembly of claim 1 having said billfold being of the one-fold type and having a bend area extending vertically at a center between the right and left ends of the billfold, said panel assembly being disposed in a position not extending across the center of said bend area of said billfold.

5. The billfold file and billfold assembly of claim 4 said panels each having a tab extending upwardly therefrom of substantially less than the dimension from left to right of the respective panel, said currency indicia being on said tabs.

6. The billfold file and billfold assembly of claim 1 said panels each having a tab extending upwardly therefrom of substantially less than the dimension from left to right of the respective panel, said currency indicia being on said tabs.

* * * * *